US008461468B2

(12) United States Patent
Cannon

(10) Patent No.: US 8,461,468 B2
(45) Date of Patent: Jun. 11, 2013

(54) MULTIDIRECTIONAL SWITCH AND TOY INCLUDING A MULTIDIRECTIONAL SWITCH

(75) Inventor: Bruce Cannon, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 195 days.

(21) Appl. No.: 12/914,148

(22) Filed: Oct. 28, 2010

(65) Prior Publication Data

US 2011/0100792 A1 May 5, 2011

Related U.S. Application Data

(60) Provisional application No. 61/256,724, filed on Oct. 30, 2009.

(51) Int. Cl.
*H01H 35/14* (2006.01)

(52) U.S. Cl.
USPC ..... 200/61.45 R; 200/61.48; 200/61.49; 200/61.5

(58) Field of Classification Search
USPC ..... 200/61.45 R–61.53; 73/514.01, 514.16, 73/514.21–514.24, 514.29, 514.35–514.38; 273/371, 374, 375, 378, 460; 446/3, 26–28, 446/175, 483–486; 463/2, 3, 7, 36–38; 472/56, 472/133; 473/140–146, 151, 152, 207, 212, 473/221, 223, 225, 266; 482/8
See application file for complete search history.

(56) References Cited

U.S. PATENT DOCUMENTS

| | | | | |
|---|---|---|---|---|
| 2,835,759 | A | 5/1958 | Waldow | |
| 2,881,276 | A | 4/1959 | Mintz et al. | |
| 3,453,405 | A * | 7/1969 | Gasik | 200/61.45 R |
| 3,707,055 | A | 12/1972 | Pearce | |
| 3,731,022 | A * | 5/1973 | Loftus | 200/61.49 |
| 3,781,496 | A | 12/1973 | Jones, Sr. | |
| 3,909,568 | A | 9/1975 | Greenhug | |
| 4,337,402 | A | 6/1982 | Nowakowski | |
| 4,496,809 | A | 1/1985 | Faust et al. | |
| 4,678,450 | A | 7/1987 | Scolari et al. | |
| 4,679,033 | A * | 7/1987 | Hwang | 340/566 |
| 4,766,275 | A | 8/1988 | Hemmann et al. | |
| 4,904,222 | A | 2/1990 | Gastgeb et al. | |
| 4,942,386 | A * | 7/1990 | Willis | 340/566 |
| 4,954,725 | A | 9/1990 | Webster | |
| 4,995,294 | A * | 2/1991 | Kashio et al. | 84/738 |
| 5,146,206 | A | 9/1992 | Callaway | |

(Continued)

FOREIGN PATENT DOCUMENTS

| | | |
|---|---|---|
| JP | 2-90061 | 3/1990 |
| JP | 06161440 A | 6/1994 |

(Continued)

*Primary Examiner* — Michael Friedhofer
(74) *Attorney, Agent, or Firm* — Edell, Shapiro & Finnan LLC

(57) ABSTRACT

A multidirectional switch includes a base, a weight coupled to the base via resilient member, and at least first and second contacts coupled to the base. The weight is biased toward a neutral position spaced from the first and second contacts. The weight is movable toward and contacts the first contact when a first force is applied to the base, which deforms the resilient member in a first direction. The weight is movable toward and contacts the second contact when a second force is applied to the base, which deforms the resilient member in a second direction different than the first direction.

18 Claims, 12 Drawing Sheets

U.S. PATENT DOCUMENTS 5,153,566 A 10/1992 Yun
5,168,138 A 12/1992 Evans
5,177,311 A 1/1993 Suzuki et al.
5,237,135 A 8/1993 Wolski
5,351,436 A 10/1994 Spalding et al.
5,354,958 A 10/1994 Bitko
5,465,197 A * 11/1995 Chien ..... 362/202
5,516,105 A 5/1996 Eisenbrey et al.
5,535,639 A 7/1996 Ogata
5,610,590 A 3/1997 Johnson et al.
5,723,786 A 3/1998 Klapman
5,741,182 A 4/1998 Lipps et al.
5,920,024 A 7/1999 Moore
5,936,159 A * 8/1999 Kano et al. ..... 73/514.36
5,947,789 A 9/1999 Chan
6,150,947 A 11/2000 Shima
6,162,123 A 12/2000 Woolston
6,183,365 B1 2/2001 Tonomura et al.
6,198,396 B1 3/2001 Frank
6,377,187 B1 4/2002 Fong
6,397,151 B1 5/2002 Yamagishi et al.
6,437,703 B1 * 8/2002 Fong ..... 340/689
6,472,864 B1 10/2002 Emo et al.
6,545,661 B1 4/2003 Goschy et al.
6,611,782 B1 8/2003 Wooster et al.
6,626,728 B2 9/2003 Holt
6,641,482 B2 11/2003 Masuyama et al.
6,747,220 B2 6/2004 Marine
6,765,160 B1 7/2004 Robinson
6,788,201 B2 9/2004 Chen et al.
6,908,386 B2 6/2005 Suzuki et al.
6,909,374 B2 6/2005 Fong
6,902,482 B1 7/2005 Woolston
6,921,332 B2 7/2005 Fukunaga et al.
6,997,773 B1 2/2006 Dubois et al.
7,002,482 B2 2/2006 Callaway
7,028,547 B2 4/2006 Shiratori et al.
7,115,824 B2 10/2006 Lo
7,196,404 B2 3/2007 Schirmer et al.
7,239,248 B2 7/2007 Fong
7,247,097 B2 7/2007 Woolston
7,326,866 B2 2/2008 Kelley, Jr. et al.
7,339,107 B2 3/2008 Remignanti
7,371,164 B2 5/2008 Ueshima
7,399,099 B2 7/2008 Stokes
7,424,388 B2 9/2008 Sato
7,426,878 B2 9/2008 Lian et al.
7,431,630 B2 10/2008 Dubois et al.
7,445,550 B2 11/2008 Barney et al.
7,450,025 B2 11/2008 Fong
7,458,699 B2 12/2008 Whiteside et al.
7,474,197 B2 1/2009 Choi et al.
7,500,917 B2 3/2009 Barney et al.
7,532,118 B2 5/2009 Gitelis
7,597,449 B2 10/2009 Stokes
2001/0024973 A1 9/2001 Meredith
2001/0031602 A1 10/2001 Sagi-Dolev
2002/0102908 A1 8/2002 Chan
2005/0017454 A1 1/2005 Endo et al.
2005/0104853 A1 5/2005 Sitalasai et al.
2005/0159072 A1 7/2005 Brown et al.
2005/0227775 A1 10/2005 Cassady et al.
2006/0019421 A1 * 1/2006 Jujii et al. ..... 438/52
2006/0059989 A1 3/2006 Wang et al.
2006/0063466 A1 3/2006 Conarro
2006/0154726 A1 7/2006 Weston et al.
2006/0166738 A1 7/2006 Eyestone et al.
2006/0264259 A1 11/2006 Zalewski et al.
2006/0287084 A1 12/2006 Mao et al.
2006/0287085 A1 12/2006 Mao et al.
2007/0049374 A1 3/2007 Ikeda et al.
2007/0060391 A1 3/2007 Ikeda et al.
2007/0149282 A1 6/2007 Lu et al.
2007/0196799 A1 8/2007 Romcevich
2007/0213109 A1 9/2007 Sato et al.
2007/0270217 A1 11/2007 Rabin
2008/0014834 A1 1/2008 Woolston
2008/0014835 A1 1/2008 Weston et al.
2008/0119269 A1 5/2008 Nonaka et al.
2008/0125224 A1 5/2008 Pollatsek
2008/0153593 A1 6/2008 Ikeda et al.
2008/0225514 A1 9/2008 Stokes
2008/0287189 A1 11/2008 Rabin
2008/0293492 A1 11/2008 Jawad et al.
2008/0300055 A1 12/2008 Lutnick et al.
2008/0305873 A1 12/2008 Zheng
2008/0311989 A1 12/2008 Ikeda
2008/0318679 A1 12/2008 Tran et al.
2009/0005166 A1 1/2009 Sato
2009/0042649 A1 2/2009 Hsieh et al.
2009/0048021 A1 2/2009 Lian et al.
2009/0062005 A1 3/2009 Lu et al.
2009/0117958 A1 5/2009 Ueshima et al.
2009/0209170 A1 8/2009 Richter
2010/0056016 A1 * 3/2010 Sonner et al. ..... 446/175

FOREIGN PATENT DOCUMENTS

JP 11290557 A 10/1999
JP 2000035793 A 2/2000
JP 2002153673 A 5/2002
JP 2002200339 A 7/2002
JP 2008135033 A 6/2008
JP 2008136694 A 6/2008
JP 2008269650 A 11/2008
WO 2004/114107 A1 12/2004

* cited by examiner

MULTIDIRECTIONAL SWITCH AND TOY INCLUDING A MULTIDIRECTIONAL SWITCH

CROSS-REFERENCE TO RELATED APPLICATION

This patent application claims the benefit of U.S. Provisional Application No. 61/256,724, filed Oct. 30, 2009, entitled "Multidirectional Switch and Toy Including a Multidirectional Switch," the entire disclosure of which is incorporated by reference in its entirety.

FIELD OF THE INVENTION

The present invention relates to a switch, and in particular a multidirectional switch that detects motion in a first direction upon application of a first force and motion in a second direction upon application of a second force.

BACKGROUND OF THE INVENTION

Various multi-sensor arrangements for detecting motion in two or directions are known. Such conventional arrangements typically provide for a plurality of sensor mechanisms, each of which detects motion along a linear axis. Other arrangements provide for multiple sensors which then extrapolate additional directional movement based on relatively complex processing algorithms.

There is a need for a multidirectional switch having a relatively simple configuration, that is inexpensive to manufacture, and that well suited to be incorporated into children's toys.

SUMMARY OF THE INVENTION

The present invention relates to a multidirectional switch. A support member is coupled to a base and extending outwardly from an upper surface of the base. A resilient member has a first end coupled to the support member and a distal second end spaced from the upper surface. A weight is coupled to the distal second end of the resilient member, and is spaced from the upper surface of the base. A first contact is coupled to the base and extends outwardly from the upper surface. A second contact is coupled to the base and extends outwardly from the upper surface. The weight is biased toward a neutral position spaced from the first contact and the second contact. The weight is movable toward and contacts the first contact when a first force is applied to the base. The first force extends the resilient member in a first direction. The weight is movable toward and contacts the second contact when a second force is applied to the base. The second force extends the resilient member in a second direction different than the first direction.

The present invention also relates to a multidirectional switch including a housing having opposing end walls and a sidewall extending between the opposing end walls. The housing defines a cavity. A weight is disposed within the cavity and coupled to one of the end walls via a resilient member. A first contact is coupled to the other end wall. The weight is movable toward and contacts the first contact when a first force is applied to the housing, which deforms the resilient member in a first direction. A second contact is coupled to the sidewall. The weight is movable toward and contacts the second contact when a second force is applied to the housing, which deforms the resilient member in a second direction different than the first direction.

In one embodiment, the second direction is substantially perpendicular to the first direction. In other embodiments, the second direction is angularly disposed relative to the first direction. In one embodiment, the first force is substantially equal to the second force. In other embodiments, the first force differs from the second force.

In one embodiment, the switch includes a brace adjacent a portion of the resilient member. In one implementation, the brace is intermediate the sidewall and a portion of the resilient member. The brace limits lateral movement of the portion of the resilient member toward the sidewall to a predetermined range of motion upon application of the second force.

In one embodiment, the housing sidewall includes a first side section and a second side section. The second contact is coupled to the first side section. A third contact is coupled to the second side section. The weight is movable toward and contacts the third contact when a third force is applied to the housing. The third force deforms the resilient member in a third direction different than the first and second directions. In some embodiments, the third force is substantially equal to the second force. In other embodiments, the third direction is substantially opposite to the second direction.

In one embodiment, the first, second and/or third contacts are electrically coupled to a sensory output mechanism. The sensory output mechanism triggers a first output when the weight contacts the first contact, triggers a second output when the weight contacts the second contact, and triggers a third output when the weight contacts the third contact.

The present invention also relates to a movement detecting toy device. The toy device includes a support body configured to be attached to or held by a user. A housing is coupled to the support body. The housing includes opposing end walls and a sidewall, and defines a cavity. A weight is disposed within the cavity and coupled to one of the end walls via a resilient member. A first contact is coupled to the other end wall. The weight is movable toward and contacts the first contact when a first force is applied to the housing, which deforms the resilient member in a first direction. A second contact is coupled to the sidewall. The weight is movable toward and contacts the second contact when a second force is applied to the housing, which deforms the resilient member in a second direction different than the first direction.

In one embodiment, the housing is configured to be coupled to an article that can be worn by a user. Alternatively, the support body is configured to be worn on a hand of the user. In addition, the device includes an output generating system that generates an output in response to the engagement of the weight with one of the first contact or the second contact.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
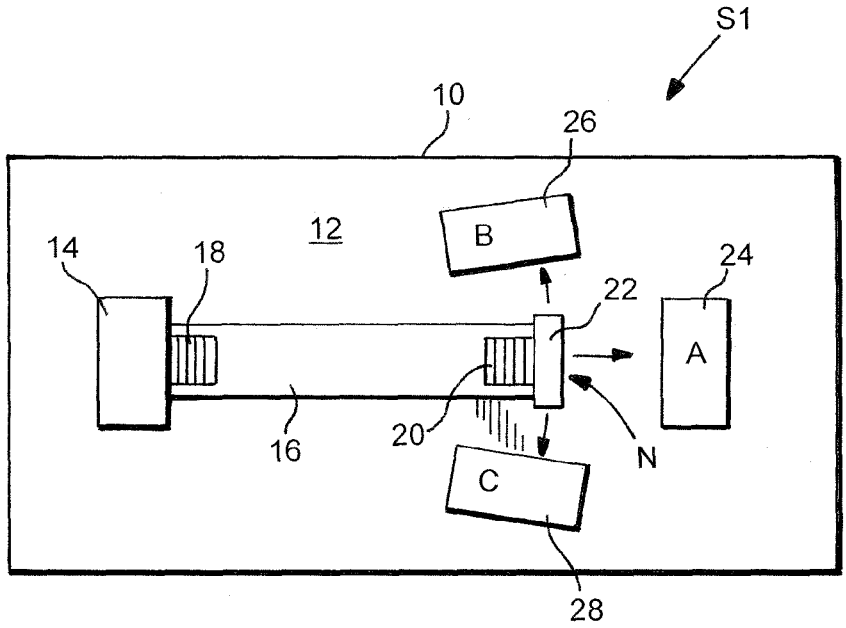
FIG. 1 illustrates a top plan schematic diagram of a multidirectional switch according to an embodiment of the present invention.
Figure 2:
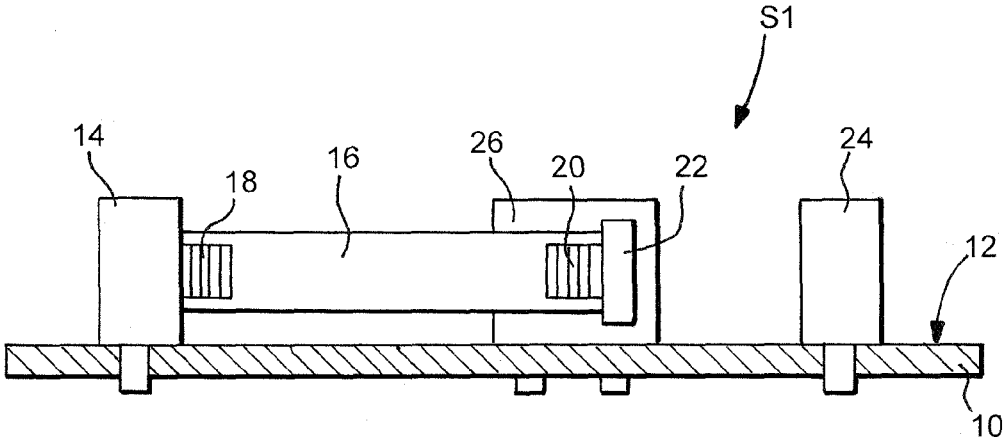
FIG. 2 illustrates a side elevational schematic diagram of the multidirectional switch of FIG. 1.

Referring to FIGS. 1 and 2, schematic diagrams of a multidirectional switch S1 according to an embodiment of the present invention are illustrated. Switch S1 includes a base 10 having an upper surface 12. A support member 14 is coupled to the base 10 and extends outwardly from the upper surface 12. A resilient member 16 has a first end 18 coupled to the support member 14, and a distal second end 20 spaced from the upper surface 12 of the base 10. A weight 22 is coupled to the distal second end 20 of the resilient member 16. The weight 22 is spaced from the upper surface 12, as shown in FIG. 2. A first contact 24 is coupled to the base 10 and extends outwardly from the upper surface 12. A second contact 26 is coupled to the base 10 and extends outwardly from the upper surface 12. The weight 22 is biased toward a neutral position N between and spaced from the first contact 24 and the second contact 26.

Figure 3:
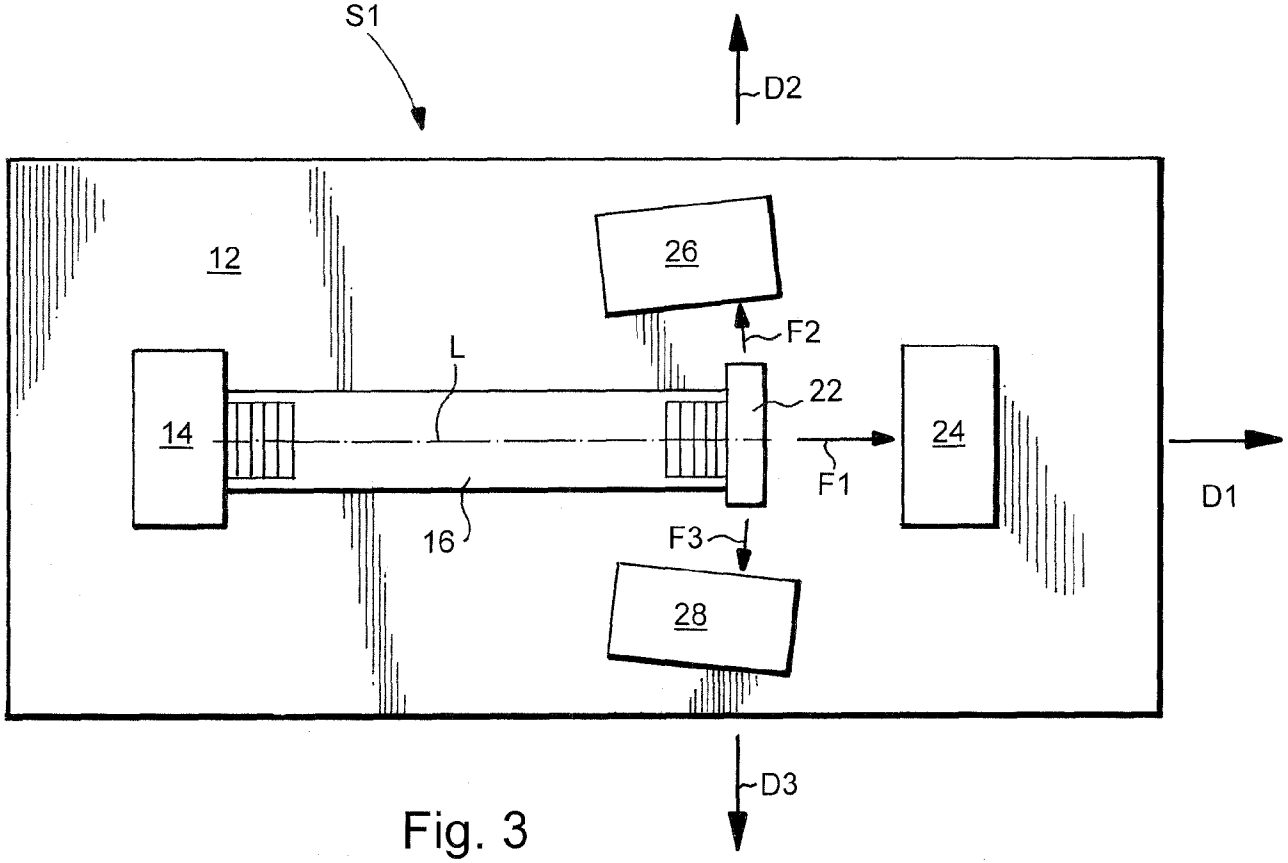
FIG. 3 illustrates another top plan schematic diagram of the multidirectional switch of FIG. 1.

Referring to FIG. 3, the weight 22 is movable toward and contacts the first contact 24 when a force (shown by arrow F1) is applied to the base 10. The force F1 deforms the resilient member 16 in a direction (shown by arrow D1) coaxial with or parallel to the longitudinal axis L of the resilient member 16. The weight 22 is movable toward and contacts the second contact 26 when another force (shown by arrow F2) is applied to the base 10. The force F2 deforms the resilient member 16 in a direction (shown by arrow D2) different than direction D1.

The force required to deform the resilient member 16 in direction D1 a distance sufficient to contact the first contact 24, or to deform the resilient member 16 in direction D2 a distance sufficient to contact the second contact 26 (and thereby closing the switch S1), depends in part on the configuration and material properties of the resilient member 16. For example, the resiliency and distance the resilient member 16 deforms in a given direction may be defined by its overall size and configuration, as well as the material from which it is formed. In addition, force requirements for closing the switch S1 are also partially dependent on the spacing between the weight 22 and the first contact 24 when the weight 22 is in its neutral position N, and the spacing between the weight 22 and the second contact 26. Further, force requirements for closing the switch S1 are partially dependent on the mass and weight of the weight 22. By adjusting one or more of these characteristics, the force requirements for closing the switch S1 may be selectively tuned. For example, the mass of weight 22 may be increased or decreased in order to adjust forward sensitivity for closing the first contact 24, or side-to-side sensitivity for closing the second contact 26.

Referring again to FIGS. 1 and 3, in one embodiment the switch S1 includes a third contact 28 coupled to the base 10 and extending outwardly from the upper surface 12. The weight 22 is disposed between and spaced from the first, second and third contacts 24, 26, 28 when in its neutral position N. The weight 22 is movable toward and contacts the third contact 28 when a force (shown by arrow F3) is applied to the base 10. The force F3 deforms the resilient member 16 in a direction (shown by arrow D3) that is different than directions D1 or D2.

In one embodiment, the second and third contacts 26, 28 are arranged on the base 10 so that direction D2 is substantially opposite to direction D3. Further, the second and third contact 26, 28 may be substantially equally spaced from the weight 22 when the weight 22 is in its neutral position N. In other embodiments, the second and third contacts 26, 28 are differently spaced from the weight 22 when the weight 22 is in its neutral position N.

The first contact 24 may be arranged on the base 10 so that direction D1 is substantially perpendicular to direction D2 and/or direction D3. Alternatively, the first contact 24, the second contact 26 and/or the third contact 28 may be arranged so that the direction D1 is angularly disposed relative to direction D2 and/or direction D3.

Figure 4:
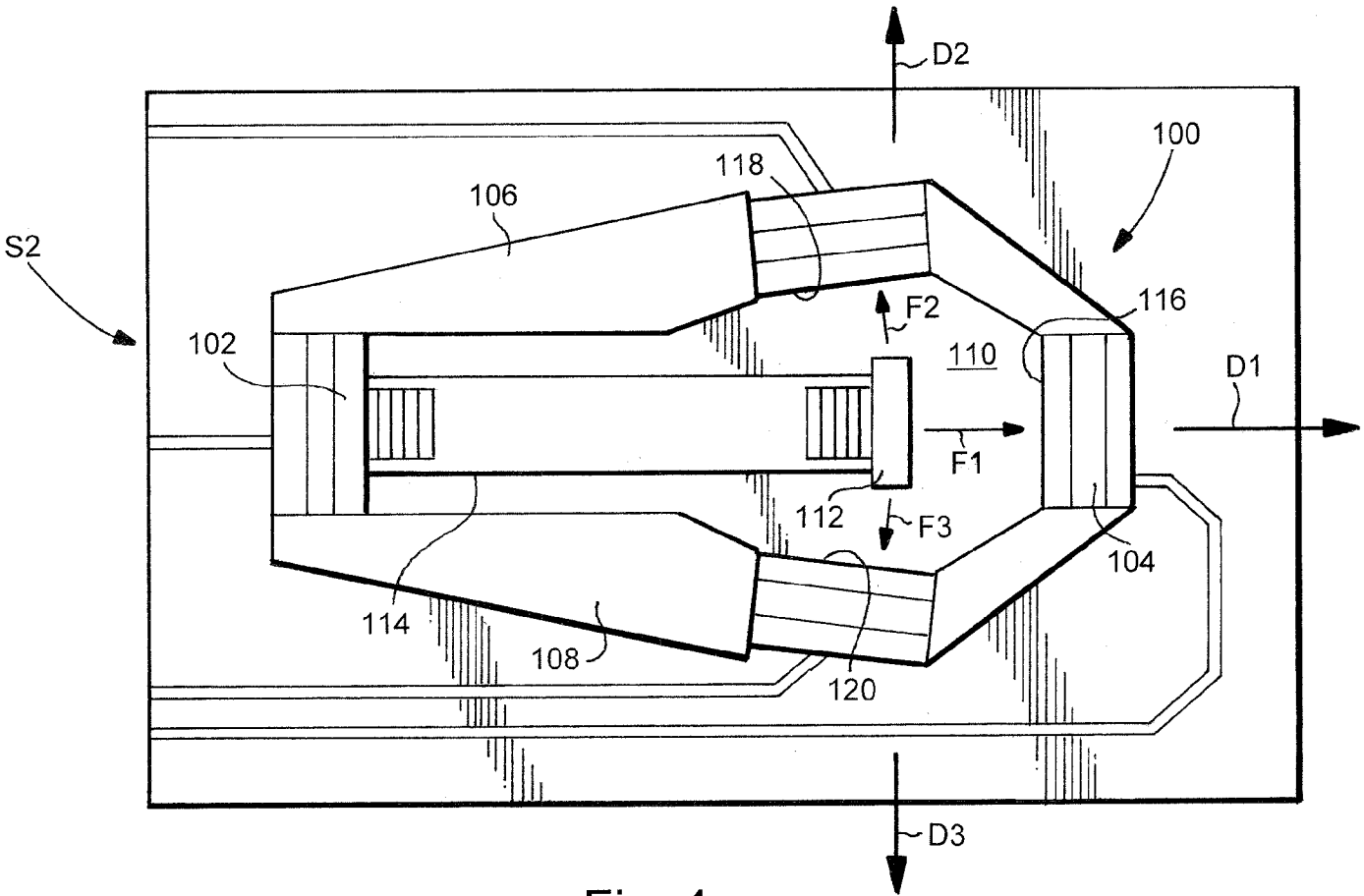
FIG. 4 illustrates a top plan schematic diagram of a multidirectional switch according to another embodiment.

A multidirectional switch S2 according to another embodiment is illustrated in FIG. 4. Switch S2 includes a housing 100 having opposing end walls 102, 104, and opposing side sections 106, 108. The housing 100 defines a cavity 110. A weight 112 is disposed within the cavity 110. The weight 112 is coupled to end wall 102 via a resilient member 114.

A first contact 116 is coupled to end wall 104, a second contact 118 is coupled to side section 106, and a third contact 120 is coupled to side section 108. The resilient member 114 biases the weight 112 toward a neutral position N between the first, second and third contacts 116, 118, 120 (such as shown in FIG. 1). In one embodiment, the weight 114 is suspended within the cavity 110 by the resilient member 114, so that the weight 112 is not in contact with the surfaces of housing 100 defining the cavity 110 when in its neutral position N.

The weight 112 is movable toward and contacts the first contact 116 when a sufficient force F1 is applied to the housing 100 that deforms the resilient member 114 in a direction D1 coaxial with or parallel to the longitudinal axis L (such as shown in FIG. 3) of the resilient member 114. The weight 112 is movable toward and contacts the second contact 118 when a force F2 is applied to the housing 100 that deforms the resilient member 114 in a direction D2 perpendicular or angularly disposed to direction D1. The weight 112 is movable toward and contacts the third contact 120 when a force F3 is applied to the housing 100 that deforms the resilient member 114 in a direction D3 perpendicular or angularly disposed to direction D1. In one embodiment, direction D2 is substantially opposite to direction D3.

In one embodiment, the force F1 required to linearly expand the resilient member 114 so that the weight 112 contacts the first contact 116 is greater than the force F2 required to laterally deform the resilient member 114 toward the side section 106 and against the second contact 118. Further, in some embodiments force F2 is substantially equal to force F3. Accordingly, force F1 may also be greater than force F3 required to laterally deform the resilient member 114 toward the side section 108 and against the third contact 120.

In one embodiment, the resilient member 114 has an elongate configuration and is formed from a material that is linearly extendable in a direction parallel to or coaxial with the longitudinal axis L of the resilient member 114 (e.g. direction D1) by a predetermined distance upon exertion of a given force (e.g. force F1). For example, in one embodiment the resilient member 114 is a coil spring. The resilient member 114 is laterally extendable in a direction away from or angular to the longitudinal axis of the resilient member 114 (e.g. direction D2 or direction D3) by a predetermined distance upon exertion of a given force (e.g. force F2 or force F3).

Figure 5:
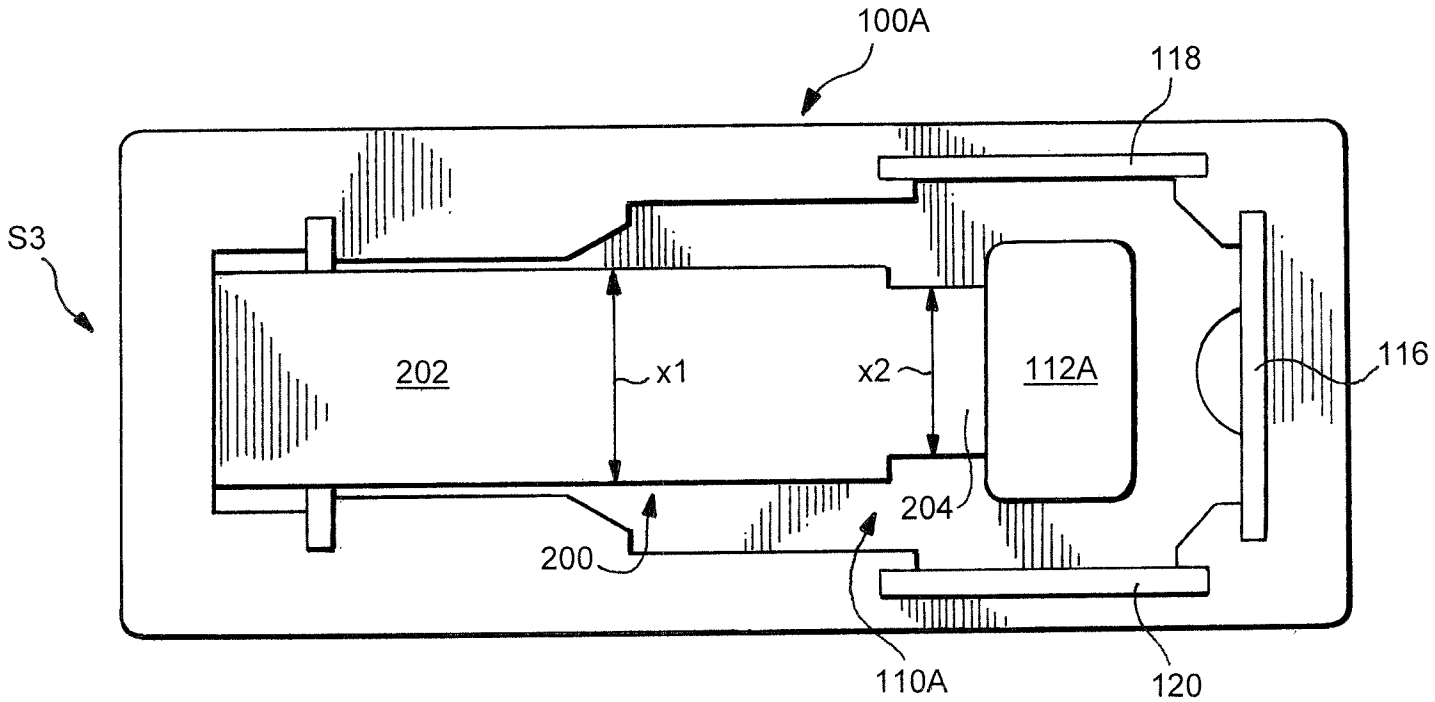
FIG. 5 illustrates a top plan schematic diagram of a multidirectional switch according to another embodiment.

In some embodiments, the resilient member 114 has a substantially uniform diameter throughout its length. In other embodiments, its diameter varies or tapers inwardly from end wall 102 to weight 112. A multidirectional switch S3 including a resilient member 200 according to an alternative embodiment is illustrated in FIG. 5. Switch S3 includes a housing 100A defining a cavity 110A, a weight 112A, and contacts 116, 118, 120, as described above.

The resilient member 200 has an elongate configuration including a first portion 202 having a first diameter x1 and a second portion 204 having a second diameter x2 differing from the first diameter x1. In one embodiment, the first diameter x1 is greater than the second diameter x2, and a greater force is required to extend or and/or deform the first portion 202 compared to the force required to extend and/or deform the second portion 204. The force required to extend the resilient member a sufficient distance so that the weight 112 contacts an associated one of the first, second or third contacts 116, 118, 120 may be determined by selecting and/or adjusting the length ratio of the first portion 202 to the second portion 204. The overall length of the resilient member 200 and its material properties also partially determine the force required to close the first, second or third contacts 116, 118, 120 via contact by the weight 112. In one embodiment, the resilient member 200 is a coil spring having sections of varying diameter, or alternatively two or more coil springs of varying diameter that are coupled together.

Figure 6:
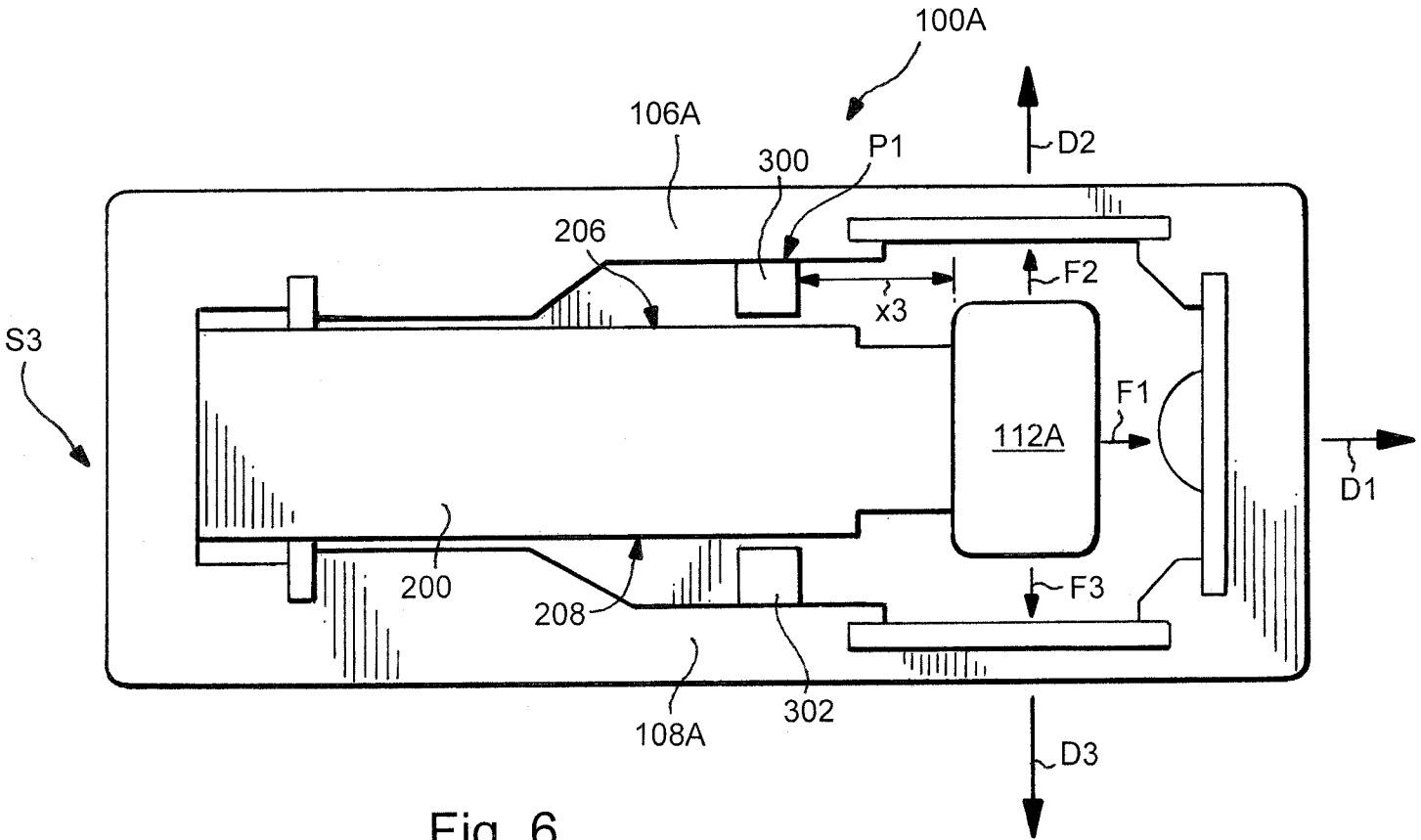
FIG. 6 illustrates another top plan schematic diagram of the multidirectional switch of FIG. 5 and including braces disposed in a first position.

Referring to FIG. 6, in one embodiment the switch S3 additional includes a brace 300 disposed intermediate a side section 106A of the housing 100A and a side portion 206 of the resilient member 200. Another brace 302 is disposed intermediate a side section 108A of the housing 100A and another side portion 208 of the resilient member 200. The force F2 required to laterally extend the resilient member 200 in direction D2 toward side section 106A is partially determined via brace 300 given brace 300 limits lateral movement of the side portion 206 of the resilient member 200 toward the side section 106A to a predetermined range of motion upon application of force F2. Similarly, the force F3 required to laterally extend the resilient member 200 in direction D3 toward side section 108A is partially determined via 302 given brace 302 limits lateral movement of the side portion 208 of the resilient member 200 toward the side section 108A to a predetermined range of motion upon application of force F3.

The specific configuration of braces 300, 302 and their positions relative to side portions 206, 208 may vary depending on the lateral range of motion in direction D2 or D3 desired. In one embodiment, braces 300, 302 have a generally post-like or rectangular configuration. The position of the braces 300, 302 relative to the weight 112 partially determines the amount of force F2, F3 required to move the weight 112 against the first contact 116 and/or the second contact 118. The braces 300, 302 act as fulcrums around or against which the resilient member 200 pivots and extends in direction D2 or direction D3, respectively. Generally, the closer the braces 300, 302 are positioned to the weight 112, the greater the amount of force required to laterally move the weight 112 against the first or second contacts 116, 118.

Figure 7:
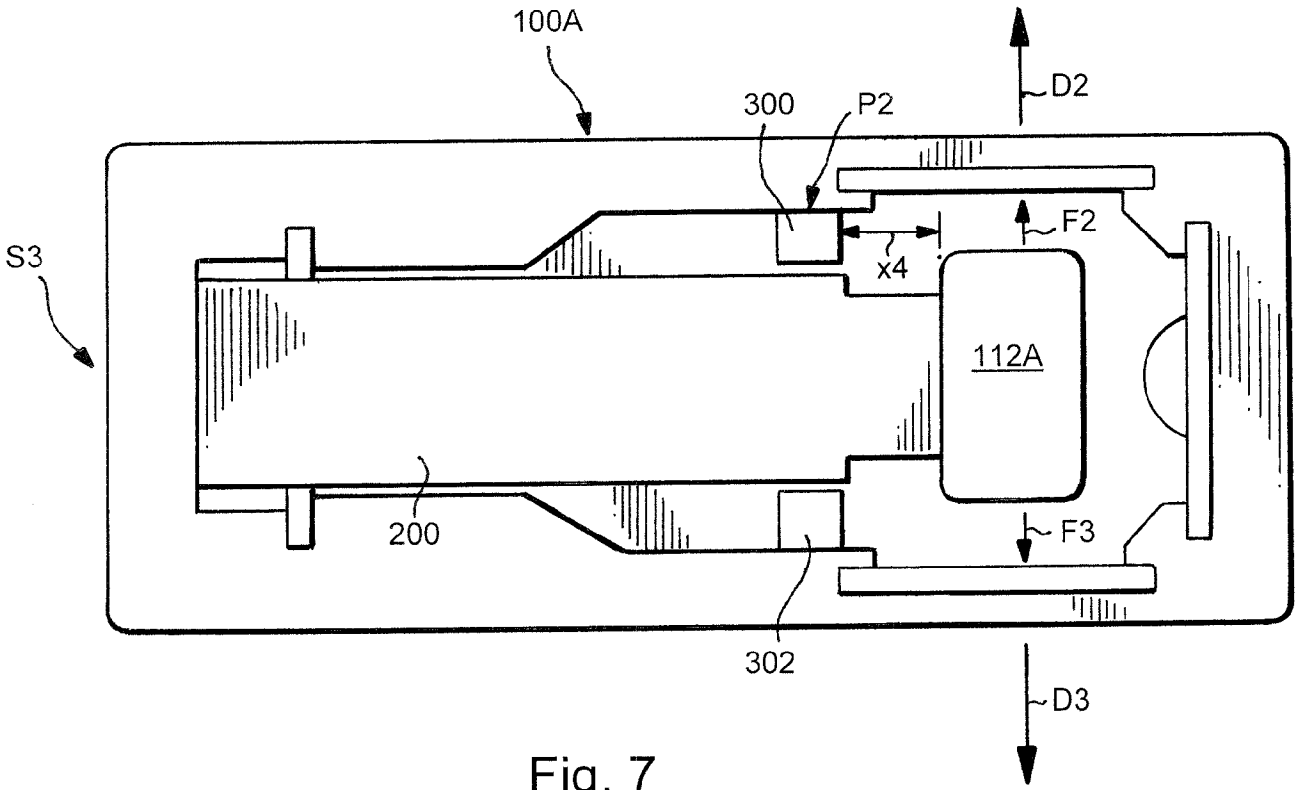
FIG. 7 illustrates another top plan schematic diagram of the multidirectional switch of FIG. 5 and including braces disposed in a second position.

Referring to FIGS. 6 and 7, the length x3 of a portion of resilient member 200 extending outwardly past the braces 300, 302 arranged in a first position P1 (shown in FIG. 6) is less than the length x4 of a portion of the resilient member 200 extending outwardly past the braces 300, 302 arranged in a second position P2 (shown in FIG. 7). The portion extending outwardly from the braces 300, 302 is relatively unhindered by braces 300, 302 in its lateral range of motion toward the side sections 106A or 108A. The positioning of braces 300, 302 shown in FIG. 7 requires a greater amount of force to extend the shorter portion (defined by length x4) of the resilient member 200 so that the weight 112A contacts the first or second contacts 118, 120, compared to the positioning of braces 300, 302 shown in FIG. 6.

In alternative embodiments, other movement limiting structures may be employed for limiting or controlling the lateral movement of the resilient member 200 toward side section 106A and/or side section 108A. In addition or alternative to a post-like structure, the braces or movement limiting structure(s) may be configured as one or more rings extending around the resilient member 200. Alternatively, the movement limiting structure(s) may be configured as one or more ribs adjacent portions of the resilient member 200. Thus, various structures may be employed for constraining and/or controlling side-to-side motion of the resilient member 200 against laterally directed forces (relative to the longitudinal axis L of the resilient member 200).

Figure 8:
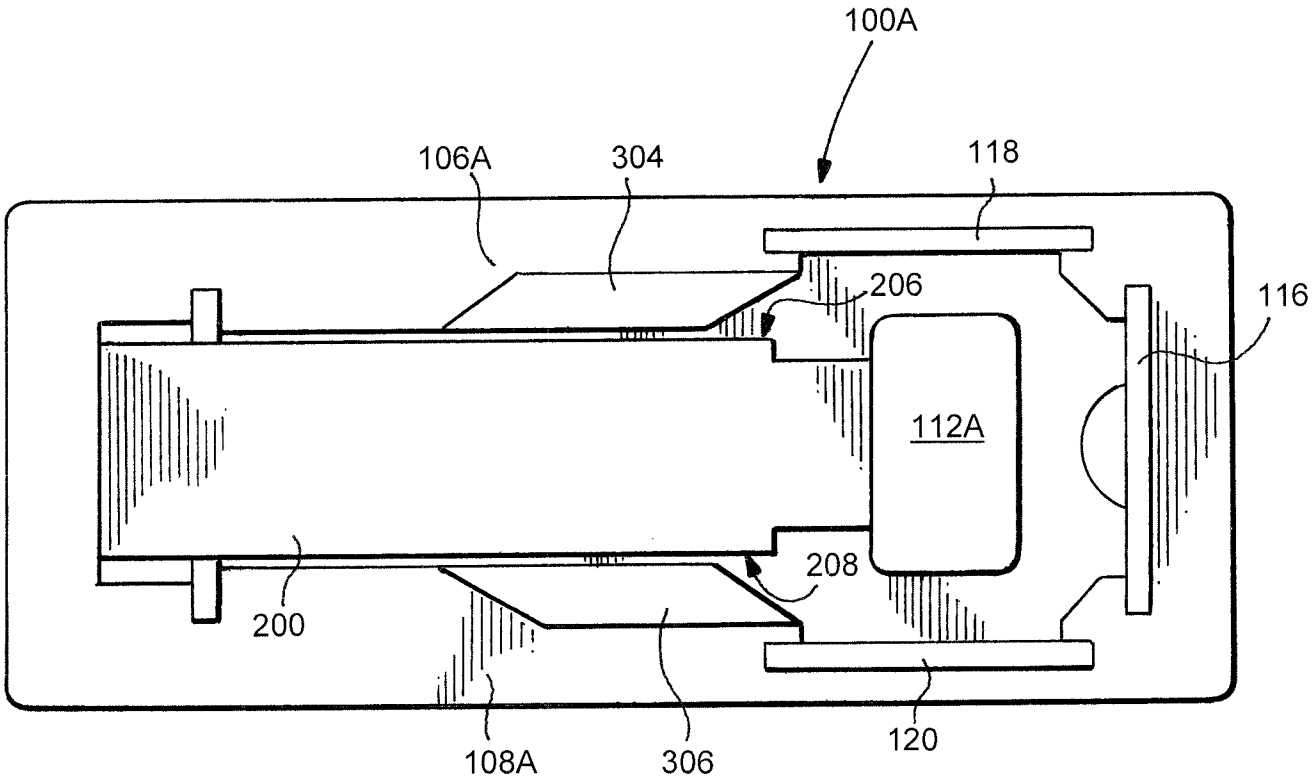
FIG. 8 illustrates another top plan schematic diagram of the multidirectional switch of FIG. 5 and including support ramps.

Referring to FIG. 8, in one embodiment the movement limiting structures are configured as ramps 304, 306. Ramp 304 is disposed intermediate side section 106A and side portion 206 of the resilient member 200, and ramp 306 is disposed intermediate side section 108A and side portion 208. Ramps 304, 306 extend along a greater surface distance of side portions 206, 208 compared to post-like braces 300, 302, and therefore provide additional support and control of side-to-side movement of the resilient member 200.

Figure 9:
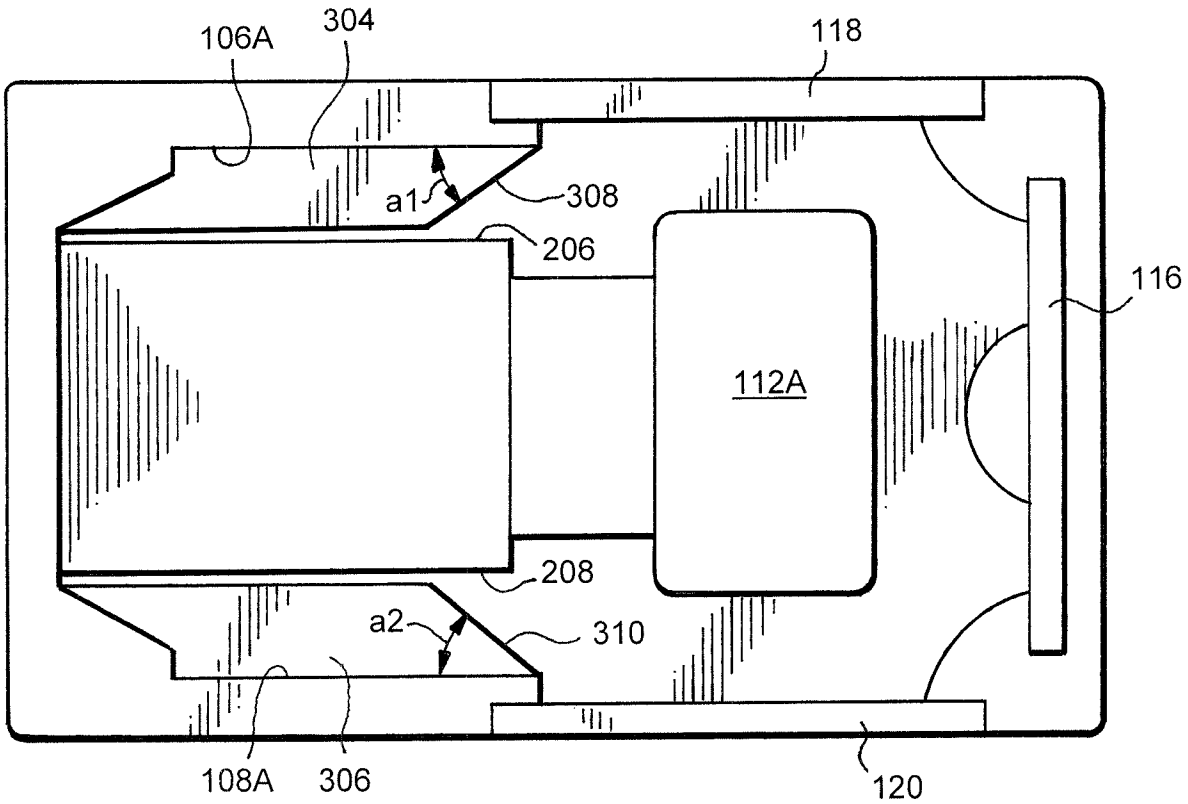
FIG. 9 illustrates another top plan schematic diagram of the multidirectional switch of FIG. 8.

Referring to FIG. 9, ramp 304 includes an end 308 having an angle of inclination a1 and sloping downwardly from the side portion 206 of the resilient member 200 toward the second contact 118. Similarly, ramp 306 includes an end 310 having an angle of inclination a2 and sloping downwardly from the side portion 208 toward the third contact 120. The distance between the ends 308, 310 of the ramps 306, 308 and the weight 112, respectively, partially determines the amount of force required to move the weight 112 against the first contact 116 and/or the second contact 118, as described above. In addition, the lateral movement of the resilient member 200 is partially determined by the angles of inclination a2, a3 of the ends 308, 310. The spacing between the corresponding side portions 206, 208 of the resilient member 200 and the side sections 106A, 108A gradually increases due to the sloped configuration of ends 308, 310. Thus, the permissible lateral movement of corresponding portions of the resilient member 200 increases as the spacing between the side portions 206, 208 and the side sections 106, 108 increases. The angles of inclination a2, a3 may thus be used to tune the force required to close the contacts 118, 120.

Figure 10:
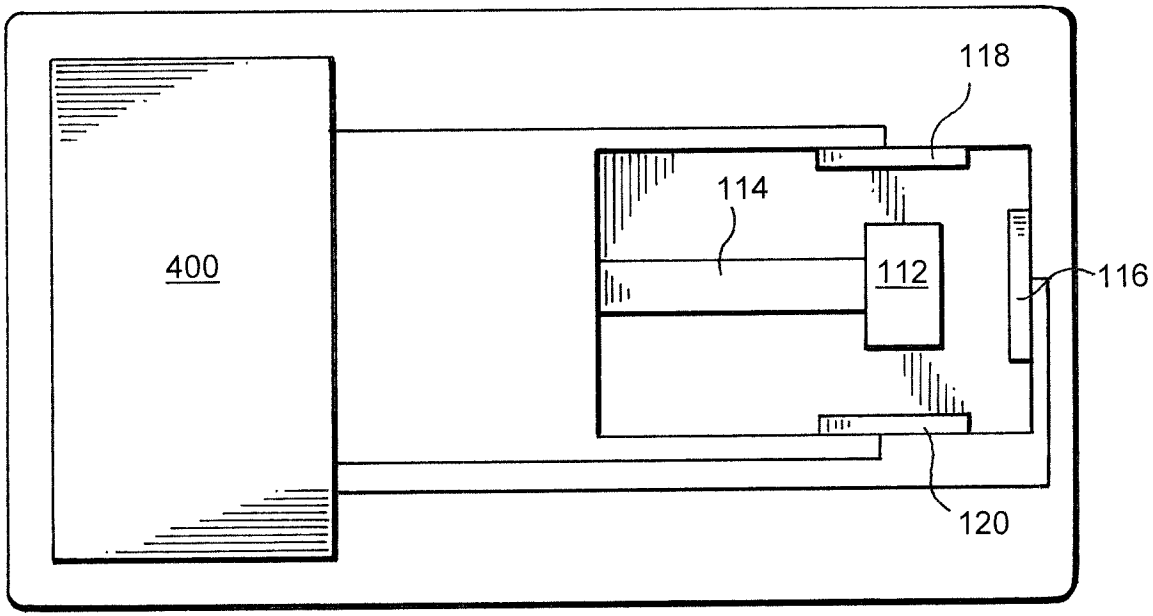
FIG. 10 illustrates a multidirectional switch coupled to a sensory output mechanism according to an embodiment of the present invention.

Referring to FIG. 10, in one embodiment each of the contacts 116, 118, 120 is electrically coupled to a sensory output mechanism 400. The switch (S1, S2 or S3) is in an open state when the weight (22, 112 or 112A) and the contacts (24, 26, 28 or 116, 118, 120) are separated. The switch (S1, S2 or S3) is closed when the weight (22, 112 or 112A) engages one of the contacts (24, 26, 28 or 116, 118, 120) to close the particular switch. When the weight (22, 112 or 112A) contacts the first, second or third contacts (24, 26, 28 or 116, 118, 120) and thus closes the switch (S1, S2 or S3), the sensory output mechanism 400 triggers an output, such as a visual or audio output. Accordingly, the sensory output mechanism 400 may include a memory configured for storing a plurality of audio outputs, such as a plurality of voice clips or sound effects, a processor for receiving and processing signals received from the contacts (24, 26, 28 or 116, 118, 120), a speaker for outputting the audio outputs and/or some other sensory output mechanism. In one embodiment, a different output is associated with closing each of the contacts (24, 26, 28 or 116, 118, 120). In other embodiments, the same output may be triggered when contacts (24, 26, 28 or 116, 118, 120) are closed.

The switches disclosed herein are relatively simply in construction, and relatively inexpensive to manufacture. Moreover, the simple design includes substantially fewer parts compared to conventional multidirectional switch arrangements. As such, the possibility of damage is minimized. The rugged switches of the present invention are particularly well suited for use in children's toys, which are often subject to substantial abuse during play.

One or more of the disclosed switches (S1, S2 or S3) may be incorporated into a variety of toys which include sensory output triggered by motion of the toy. Exemplary toys according to embodiments of the present invention include a support body, a switch (S1, S2 or S3) coupled to the support body, and a sensory output mechanism (400) coupled to the support body and electrically coupled to the switch (S1, S2 or S3). Movement of the support body triggers one or more contacts in the switch and triggers a sensory output as described above.

Figure 11:
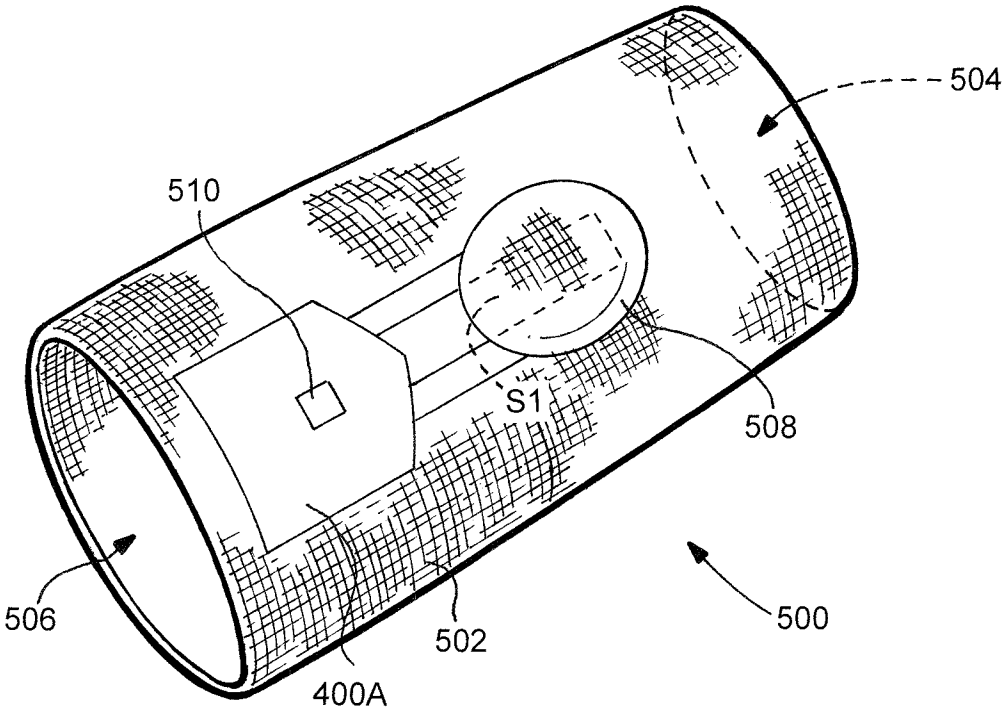
FIG. 11 illustrates a wrist toy including a multidirectional switch according to an embodiment of the present invention.

An exemplary toy 500 including a multidirectional switch according to an embodiment of the present invention is illustrated in FIG. 11. The toy 500 is configured as a glove or wristband having a support body 502 defining openings 504, 506 at opposite ends thereof and configured for accommodating a user's wrist. In one embodiment, the support body 502 is formed from a flexible material, such a fabric material. In other embodiments, the support body 502 is formed from a semi-flexible or rigid material, such as a polymer material. A switch S1 (or S2 or S3) is coupled to the support body 502. In one embodiment, the switch S1 (or S2 or S3) is enclosed within a protective casing, which is in turn secured within a cavity defined by an additional layer of material 508 and an exteriorly disposed surface of the support body 502. The switch S1 (or S2 or S3) is electrically coupled to a sensory output mechanism 400A, which is coupled to the support body 502.

Figure 12A:
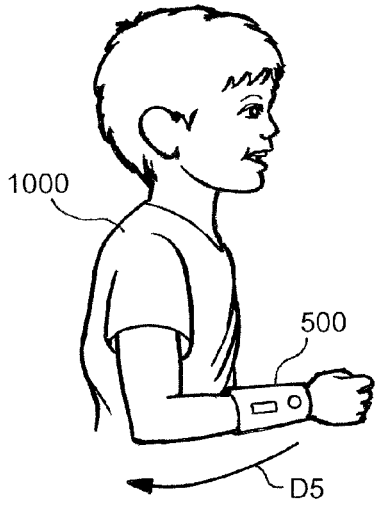
FIG. 12A illustrates a side elevational view of a user wearing the toy of FIG. 11 and with the user's arm in a retracted position.
Figure 12B:
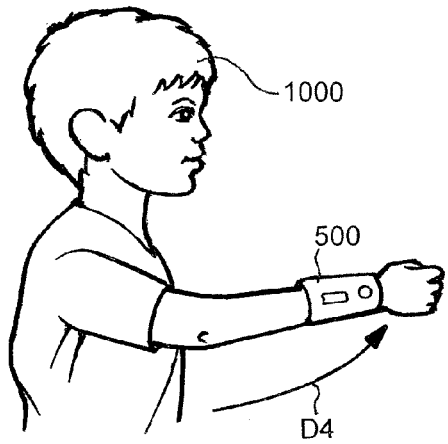
FIG. 12B illustrates a side elevational view of the user wearing the toy of FIG. 11 and with the user's arm in an extended position.
Figure 13A:
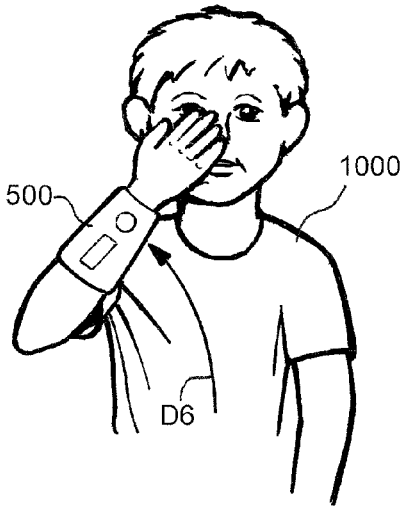
FIG. 13A illustrates a front elevational view of the user wearing the toy of FIG. 11 and with the user's arm in a raised position.
Figure 13B:
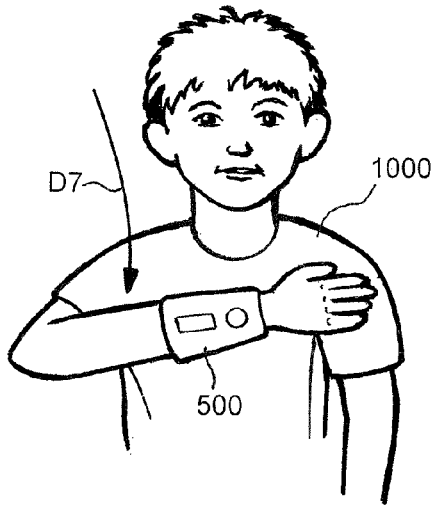
FIG. 13B illustrates a front elevational view of the user wearing the toy of FIG. 11 and with the user's arm in a lowered position.

The toy 500 detects via switch S1 (or S2 or S3) a forward thrusting or punching motion by a user 1000 in a forward direction, and/or retracting motion in a backward direction, as shown in FIGS. 12A and 12B by arrows D4 and D5. In addition, the toy 500 detects via switch S1 (or S2 or S3) an up and down or side-to-side motion (dependent in part on the orientation of the user's hand), for example as shown in FIGS. 13A and 13B by arrows D6 and D7.

The support body 502 moves in a given direction (e.g. direction D4, D5, D6 or D7) until the user stops motion of his or her hand or wrist, such as when the user's arm is fully extended in the punching motion. The momentum created during the forward, side-to-side, up and down, etc. motion of the user's hand exerts a force upon the weight 112 within the switch S1 (or S2 or S3) as the motion of the toy 500 decelerates or stops. A sufficient force F1 (as determined by the properties of the resilient member and/or the weight, spacing between the weight and contacts, and/or position and configuration of braces, ramps or other movement limiting structures) causes the weight 112 to contact a corresponding contact, thereby closing the switch S1 (or S2 or S3). A signal is then communicated to the sensory output mechanism 400A, which triggers an audio output, such as a 'striking' sound effect or a voice clip. Audio output may also be triggered via activation of an actuator button 510 operably associated with the sensory output mechanism 400A.

In one embodiment, the switch S1 (or S2 or S3) of toy 500 is configured so that a larger linear force is required to close the first contact 116, compared to a smaller side-to-side force required to close either the second or third contacts 118, 120. For example, the first contact 116 is contacted and closed by the weight 112 by a force F1 of more than three gravities. The second and third contacts 118, 120 are contacted and closed by the weight 112 by a force F2 and/or F3 of less than two gravities.

In one embodiment, each output associated with the closing of the first, second, and third contacts 116, 118, 120 in the toy 500 is different. In other embodiments, one of a plurality of audio outputs is associated with the closing of each of the first, second, and third contacts 116, 118, 120. For example, a first closing of the first contact 116 may trigger the generation of a first audio output; the subsequent closing of the first contact 116 may trigger the generation of a second audio output; the next closing of the first contact 116 may trigger the generation of a third audio output, etc. Alternatively, several audio outputs may be associated with the closing of the first contact 116, and one of the outputs is randomly selected and output via mechanism 400A. The second and third contacts 118, 120 may be similarly configured, and include more or fewer audio outputs.

In one embodiment, the specific sound effects output by the sensory output mechanism 400A relate to a particular theme. For example, the particular theme may be associated with wrestling, including punching sound effects and voice clips of various wrestling characters. Alternatively, the sound effects may be associated with an underwater theme including bubbling and splashing noises, or a space theme including blaster gun or rocket launch noises. Further, the toy 500 may include other sensory output, such as lights, tactile stimuli such as vibrations, etc.

Figure 14:
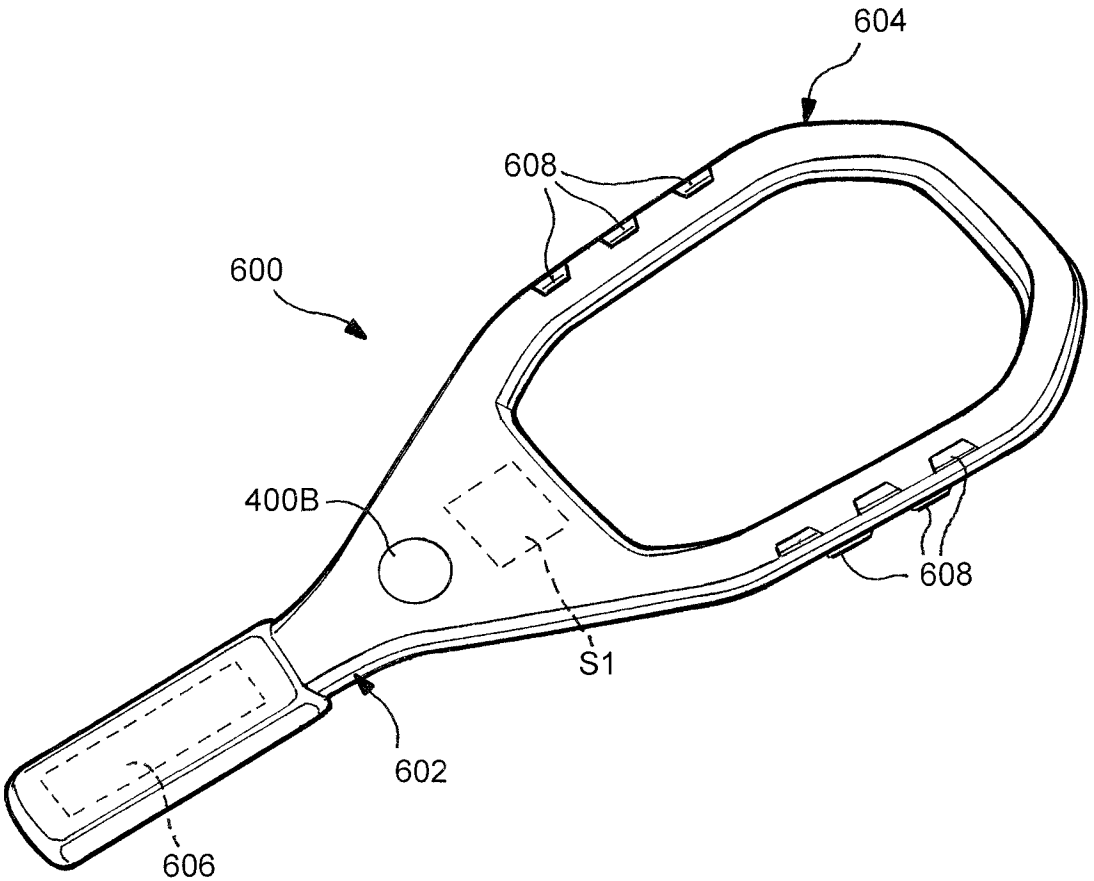
FIG. 14 illustrates a perspective view of a racquet toy including a multidirectional switch according to an embodiment of the present invention.

Another exemplary toy 600 including a multidirectional switch according to an embodiment of the present invention is illustrated in FIG. 14. The toy 600 is configured as a racquet having a handle portion 602 and a hoop portion 604. A switch S1 (or S2 or S3) is disposed within a correspondingly configured cavity defined by the handle portion 602. The switch S1 (or S2 or S3) is electrically coupled to a sensory output mechanism 400B disposed on the handle portion 602.

The toy 600 detects via switch S1 (or S2 or S3) motion of the toy 600, such as when a user swings the racket in a forward, back or side-to-side motion, as described above. A signal is then communicated to the sensory output mechanism 400B, which triggers an audio output, such as a 'whooshing' sound, a racquet strike sound, or a voice clip (e.g. "Beat That," "Game Point," etc.). Alternatively or in addition, the sensory output mechanism 400B may trigger a tactile output, such as a vibration device 606 disposed within a correspondingly configured cavity in the handle portion 602. Alternatively or additionally, the sensory output mechanism 400B may trigger a visual output, such as lights 608 disposed along a periphery of the hoop portion 604.

The wrist toy 500 and racquet toy 600 are exemplary only. The switch of the present invention may be incorporated into a variety of differently configured toy devices, including but not limited to other sports equipment such as bats or golf clubs, other wearable devices such as boots or helmets, toy vehicles, etc. Moreover, the switch may include fewer than three contacts, or more than three contacts, as desired and pursuant to application requirements. Further, two or more of the switches of the present invention may be incorporated into a support body.

Therefore, although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. Further, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A multidirectional switch comprising:

a base having an upper surface;

a support member coupled to the base and extending outwardly from the upper surface;

a resilient member having a first end coupled to the support member and a distal second end spaced from the upper surface;

a weight coupled to the distal second end of the resilient member and spaced from the upper surface;

a first contact coupled to the base and extending outwardly from the upper surface;

a second contact coupled to the base and extending outwardly from the upper surface, the weight biased toward a neutral position spaced from the first contact and the second contact, wherein the weight is movable toward and contacts the first contact when a first force is applied to the base, the first force extending the resilient member in a first direction, and the weight is movable toward and contacts the second contact when a second force is applied to the base, the second force extending the resilient member in a second direction different than the first direction; and a non-conductive brace adjacent a portion of the resilient member, the brace limiting lateral movement of the portion of the resilient member to a predetermined range of motion upon application of the second force.

2. The multidirectional switch of claim 1, wherein the second direction is angularly disposed relative to the first direction.

3. A multidirectional switch comprising:

a housing including a first end wall, a second end wall opposite the first end wall, and a sidewall extending between the first end wall and the second end wall, the housing defining a cavity;

a weight disposed within the cavity and coupled to the first end wall via a resilient member;

a first contact coupled to the second end wall, the weight movable toward and contacting the first contact when a first force is applied to the housing, the first force deforming the resilient member in a first direction;

a second contact coupled to the sidewall, the weight movable toward and contacting the second contact when a second force is applied to the housing, the second force deforming the resilient member in a second direction different than the first direction; and a non-conductive brace intermediate the sidewall and a portion of the resilient member, the brace limiting lateral movement of the portion of the resilient member toward the sidewall to a predetermined range of motion upon application of the second force.

4. The multidirectional switch of claim 3, wherein the second direction is substantially perpendicular to the first direction.

5. The multidirectional switch of claim 3, wherein the second direction is angularly disposed relative to the first direction.

6. The multidirectional switch of claim 3, wherein the first force is substantially equal to the second force.

7. The multidirectional switch of claim 3, wherein the sidewall includes a first side section and a second side section, the second contact coupled to the first side section, further comprising a third contact coupled to the second side section, the weight movable toward and contacting the third contact when a third force is applied to the housing, the third force deforming the resilient member in a third direction different than the first and second directions.

8. The multidirectional switch of claim 7, wherein the second force is substantially equal to the third force.

9. The multidirectional switch of claim 7, wherein the third direction is substantially opposite to the second direction.

10. The multidirectional switch of claim 3, wherein the first contact is electrically coupled to a sensory output mechanism, the sensory output mechanism triggering a first output when the weight contacts the first contact.

11. The multidirectional switch of claim 10, wherein the second contact is electrically coupled to the sensory output mechanism, the second output mechanism triggering a second output when the weight contacts the second contact.

12. The multidirectional switch of claim 3, wherein the housing is configured to be coupled to an article that can be worn by a user.

13. A movement detecting toy device comprising:

a support body configured to be attached to or held by a user;

a housing including a first end wall, a second end wall opposite the first end wall, and a sidewall extending between the first end wall and the second end wall, the housing defining a cavity;

a weight disposed within the cavity and coupled to the first end wall via a resilient member;

a first contact coupled to the second end wall, the weight movable toward and contacting the first contact when a first force is applied to the housing, the first force deforming the resilient member in a first direction;

a second contact coupled to the sidewall, the weight movable toward and contacting the second contact when a second force is applied to the housing, the second force deforming the resilient member in a second direction different than the first direction; and a non-conductive ramp intermediate the sidewall and a portion of the resilient member, the ramp limiting lateral movement of the portion of the resilient member toward the sidewall to a predetermined range of motion upon application of the second force.

14. The movement detecting toy device of claim 13, wherein the support body is configured to be worn on a hand of the user.

15. The movement detecting toy device of claim 13, further comprising:

an output generating system that generates an output in response to the engagement of the weight with one of the first contact or the second contact.

16. The movement detecting toy device of claim 13, wherein the second direction is substantially perpendicular to the first direction.

17. The movement detecting toy device of claim 16, wherein the first force is substantially equal to the second force.

18. The movement detecting toy device of claim 13, further comprising a third contact coupled to the sidewall, the weight movable toward and contacting the third contact when a third force is applied to the housing, the third force deforming the resilient member in a third direction different than the first and second directions.

* * * * *